US006261178B1

(12) United States Patent
Bennett

(10) Patent No.: US 6,261,178 B1
(45) Date of Patent: Jul. 17, 2001

(54) SLOT MACHINE GAME WITH DYNAMIC PAYLINE

(75) Inventor: Nicholas Luke Bennett, Manly Vale (AU)

(73) Assignee: Aristocrat Technologies Australia Pty Ltd., New South Wales (AU)

( * ) Notice: Subject to any disclaimer, the term of this patent is extended or adjusted under 35 U.S.C. 154(b) by 0 days.

(21) Appl. No.: 09/142,030

(22) PCT Filed: Feb. 28, 1997

(86) PCT No.: PCT/AU97/00122

§ 371 Date: Aug. 26, 1998

§ 102(e) Date: Aug. 26, 1998

(87) PCT Pub. No.: WO97/32286

PCT Pub. Date: Sep. 4, 1997

(30) Foreign Application Priority Data

Feb. 28, 1996 (AU) ..... PN 8363

(51) Int. Cl.[7] ..... G07F 17/34
(52) U.S. Cl. ..... 463/20; 273/143 R; 273/138.2
(58) Field of Search ..... 463/20; 273/143 R, 273/138.1, 138.2, 138 A, 138 R

(56) References Cited

U.S. PATENT DOCUMENTS 4,198,052 * 4/1980 Gauselmann ..... 273/143 R
4,365,810 * 12/1982 Richardson ..... 273/237
4,475,157 * 10/1984 Bolan ..... 273/269
5,332,228 * 7/1994 Schultz ..... 273/292
5,393,057 * 2/1995 Marnell, II ..... 273/269
5,580,053 12/1996 Crouch ..... 463/20
5,611,535 * 3/1997 Tiberio ..... 273/143 R
5,772,506 * 6/1998 Marks ..... 463/13

FOREIGN PATENT DOCUMENTS 0058488 1/1982 (EP) .
9608799 9/1995 (WO) .

* cited by examiner

*Primary Examiner*—Benjamin H. Layno
(74) *Attorney, Agent, or Firm*—Rosenman & Colin, LLP.

(57) ABSTRACT

It is normal for machines of the type having multiple pay lines available, that the player would purchase the option of playing for a win on lines other than the centre line. In order to add further player interest, the game is also provided with a random feature whereby under certain circumstances, a further combination of symbol positions. referred to as the "mystery line", will be randomly selected by the machine's controller to give the player another winning opportunity. A prize is paid to the player in the event that a predetermined combination of symbols is displayed in the randomly selected arrangement of symbol locations, "mystery line".

16 Claims, 3 Drawing Sheets

SLOT MACHINE GAME WITH DYNAMIC PAYLINE

INTRODUCTION

The present invention relates to gaming machines of the type generally referred to as slot machines, fruit machines or poker machines, and in particular the invention provides an improvement to a game played on such a machine.

Players who regularly play gaming machines quickly tire of particular games and therefore it is necessary for manufacturers of these machines to come up with innovative game features that add interest to the games provided on such machines in order to keep the players amused and therefore willing to continue playing the game.

DESCRIPTION OF THE PRIOR ART

Gaming or poker machines have been well known in the state of New South Wales for many years and have more recently gained considerable popularity throughout Australia, with quite substantial amounts of money wagered on these machines. There is a growing tendency for State governments to legalize the use of gaining machines by licensing operators, with resulting revenue gains through license fees and taxation of monies invested. The licensed operation of gaming machines is the subject of State legislation and regulation. This regulation most always dictates a minimum percentage payout for a gaming machine. For example, a minimum of 85% of monies invested must be returned as winnings, and manufacturers of gaming machines therefore must design their machines around these regulatory controls.

With the growth that has occurred in the gaming machine market there is intense competition between manufacturers to supply the various existing and new venues. When selecting a supplier of gaming machines, the operator of a venue will often pay close attention to the popularity of various games with their patrons.

Therefore, gaming machine manufacturers are keen to devise games which are popular with players, as a mechanism for improving sales.

Many various strategies have been tried in the past to make games more enticing to players, and these strategies are often aimed at either increasing the maximum prize payable on a machine or creating at least the perception of more winning opportunities. The present invention falls into the latter category. For quite a few years, it has been possible to bet on more than one pay line of a slot machine simultaneously. However this feature has been restricted by the number of pay lines that could be achieved on the display format commonly used in slot machines. It should be noted that while early machines exhibited "paylines" which comprised linear combinations of display symbol locations, in more recent times more complicated arrangements of display symbol locations have been employed as "paylines". Throughout this specification the term "payline" will be taken to include any arrangement of symbol locations having the requisite characteristics to be a payline. This may include the requirement that the line includes only one symbol location in each display column, in the case of spinning reel machines, but may not include this restriction in the case of video display machines.

The present invention provides an arrangement whereby in addition to the paylines defined on the machine artwork, a further set of randomly selected symbol locations will be counted as a payline in each game.

SUMMARY OF THE INVENTION

The present invention consists in a gaining machine having display means arranged to display a plurality of symbols in an array of n rows and m columns, game control means arranged to control images displayed on the display means the game control means being arranged to pay a prize when a predetermined combination of symbols is displayed in a predetermined arrangement of symbol locations displayed on the display means, the gaming machine being characterised in that during each game a further arrangement of symbol locations is randomly selected and a prize is paid in the event that a predetermined combination of symbols is displayed in the randomly selected arrangement of symbol locations.

Preferably, the randomly selected arrangement of symbol locations will include one location in every column of the display and more preferably only one location in each column.

The preferred embodiments of the invention use a display means which displays symbols in 3 rows and 3, 4 or 5 columns.

In particular embodiments, a player may cause the machine to randomly select more than one additional arrangement of locations in a game, with each such arrangement including one and only one symbol location in each column of the display.

The invention is equally applicable to video machines and machines employing spinning reels.

BRIEF DESCRIPTION OF THE DRAWINGS

Embodiments of the present invention will now be described by way of example with reference to the accompanying drawings in which.

DETAILED DESCRIPTION OF THE PREFERRED EMBODIMENTS

In the following detailed description, the methodology of the embodiments will be described and it is to be understood that it is within the capabilities of the non-inventive worker in the art to introduce the methodology on any standard microprocessor base gaming machine by means of appropriate programming.

Traditional slot machines have made use of spinning reels to provide a display function with symbols carried on the reels being aligned to produce a game result which may or may not be a winning combination. Traditionally, such machines paid a prize only on a centre row combination, however over the years more complex pay arrangements have been developed in which winning combinations could appear on horizontal lines above and follow the centre row line, and later on diagonal lines (typically on 3 reel machines).

In more recent times video displays have been used to simulate spinning reels on these types of machines and in some instances machines have been provided with matrices of pseudo spinning wheels such as a 3×3 matrix of reels, whereby every single position on the display screen is essentially independently randomly achieved and therefore it was valid to pay on vertical combinations as well as horizontal combinations. In such a machine with a 3×3 symbol matrix display, winning combinations could be achieved on any one of three horizontal pay lines, three vertical paylines and two diagonals, making 8 possible lines on which a result could be assessed.

It is normal for machines of the type having multiple pay lines available, that the player would purchase the option of playing for a win on lines other than the centre line. That is to say, if the player wagered only one token he played only for a winning combination on one line, whereas if he wagered a number of tokens he may well select to wager some of those tokens on lines other than the centre line of the display.

This mechanism adds interest to the game being played by the player as essentially it enables him to make multiple bets simultaneously.

Figure 1:
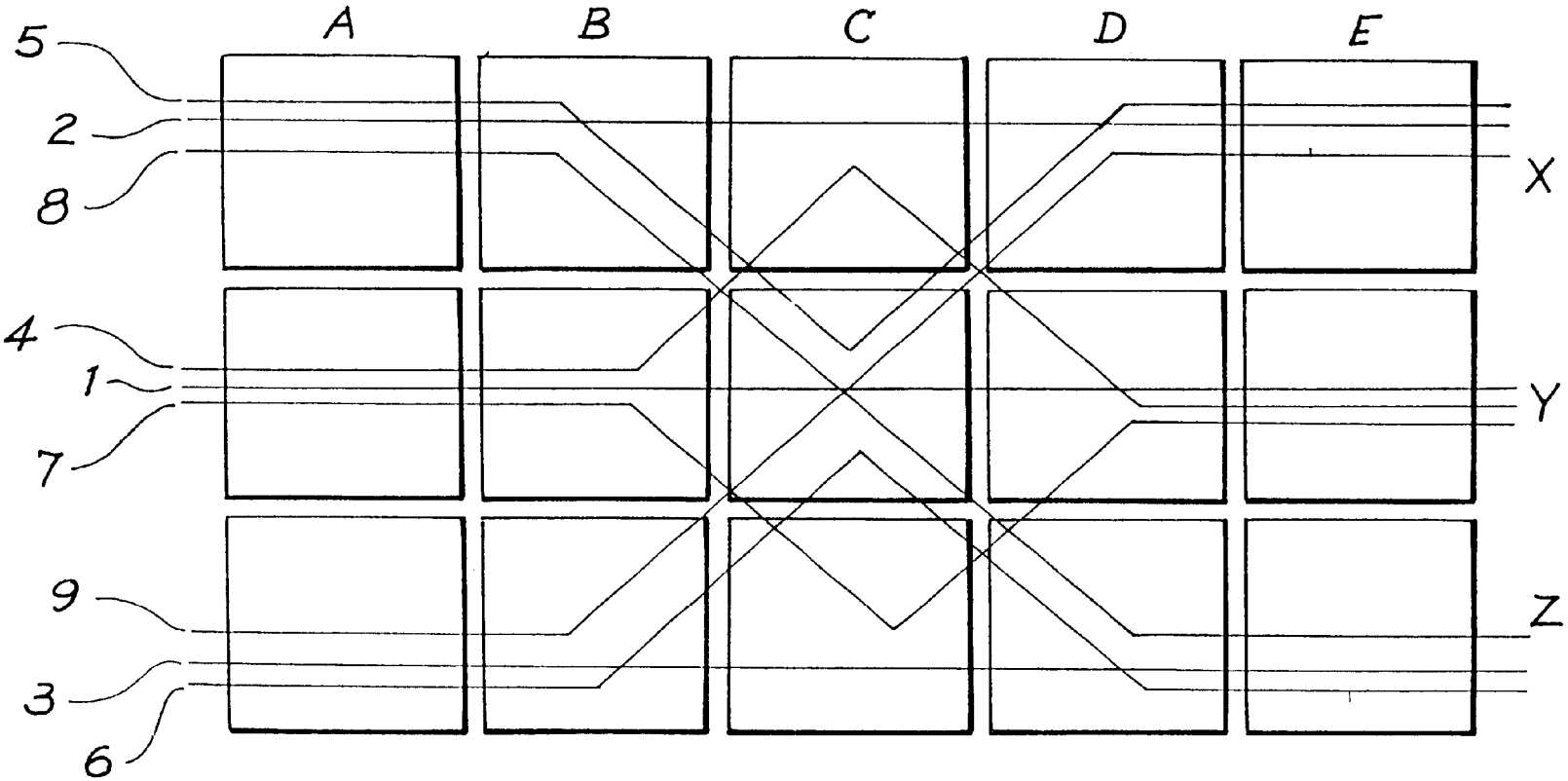
FIG. 1 diagrammatically illustrates a conventional 3 line multi-line pay arrangement for a machine with a 3×5 display format.

Referring to FIG. 1, a matrix symbolic of a typical three line by five column display matrix is illustrated, and it will be immediately apparent that in such an arrangement diagonal pay lines as conventionally used in 3×3 symbol matrix machines are not appropriate to the 3×5 format. Similarly, in slot machines which play games which follow the traditional format of a plurality of vertical spinning reels, vertical pay lines are not appropriate as there is no significant degree of randomness in the combinations provided on the vertical line.

Therefore, with this in mind the first embodiment of the present invention provides an arrangement for a slot machine having a 3×5 symbol matrix display with 9 possible predefined prize paying arrangements of symbol locations as illustrated in the diagram of FIG. 1. Referring to the symbol positions of the display by their matrix row and column designations (e.g. AX for the top left hand corner and EZ for the bottom right hand corner). It will be noted that the first row in this arrangement comprises the symbol positions AX, BX, CX, DX, EX and the ninth line comprises the symbol positions AZ, BZ, CY, DX, EX. All of the line combinations of FIG. 1 are illustrated in Table 1 below.

TABLE 1

| LINE NO | DISPLAY POSITIONS USED |
|---|---|
| 1 | AY, BY, CY, DY, EY |
| 2 | AX, BX, CX, DX, EX |
| 3 | AZ, BZ, CZ, DZ, EZ |
| 4 | AY, BY, CX, DY, EY |
| 5 | AX, BX, CY, DX, EX |
| 6 | AZ, BZ, CY, DZ, EZ |
| 7 | AY, BY, CZ, DY, EY |
| 8 | AX, BX, CY, DZ, EZ |
| 9 | AZ, BZ, CY, DX, EX |

In order to add further player interest, the game is also provided with a random feature whereby under certain circumstances, a further combination of symbol positions, referred to as the "mystery line", will be randomly selected by the machine's controller to give the player another winning opportunity. Typically the mystery line would have one and only one symbol position in each column of the display and would not be one of the combinations illustrated in FIG. 1 and detailed in Table 1. The circumstances under which a mystery line would be awarded to the player may vary depending upon the game style, but one possible arrangement would involve awarding a mystery line on any occasion when a player plays a game and no prize is won on any of the 9 predefined prize paying arrangements of symbol locations. Alternatively, the mystery line could be provided if no prize is won on any of the predefined prize paying arrangements of symbol locations selected by the player.

Given that the display in the described embodiment has 3×5 symbol positions, there are $3^5$=243 possible combinations having one symbol position in each column. Therefore, in a machine having 9 predefined paying arrangements of symbol locations there will be 234 normally non prize paying arrangements which are available for selection as a mystery line.

Figure 2:
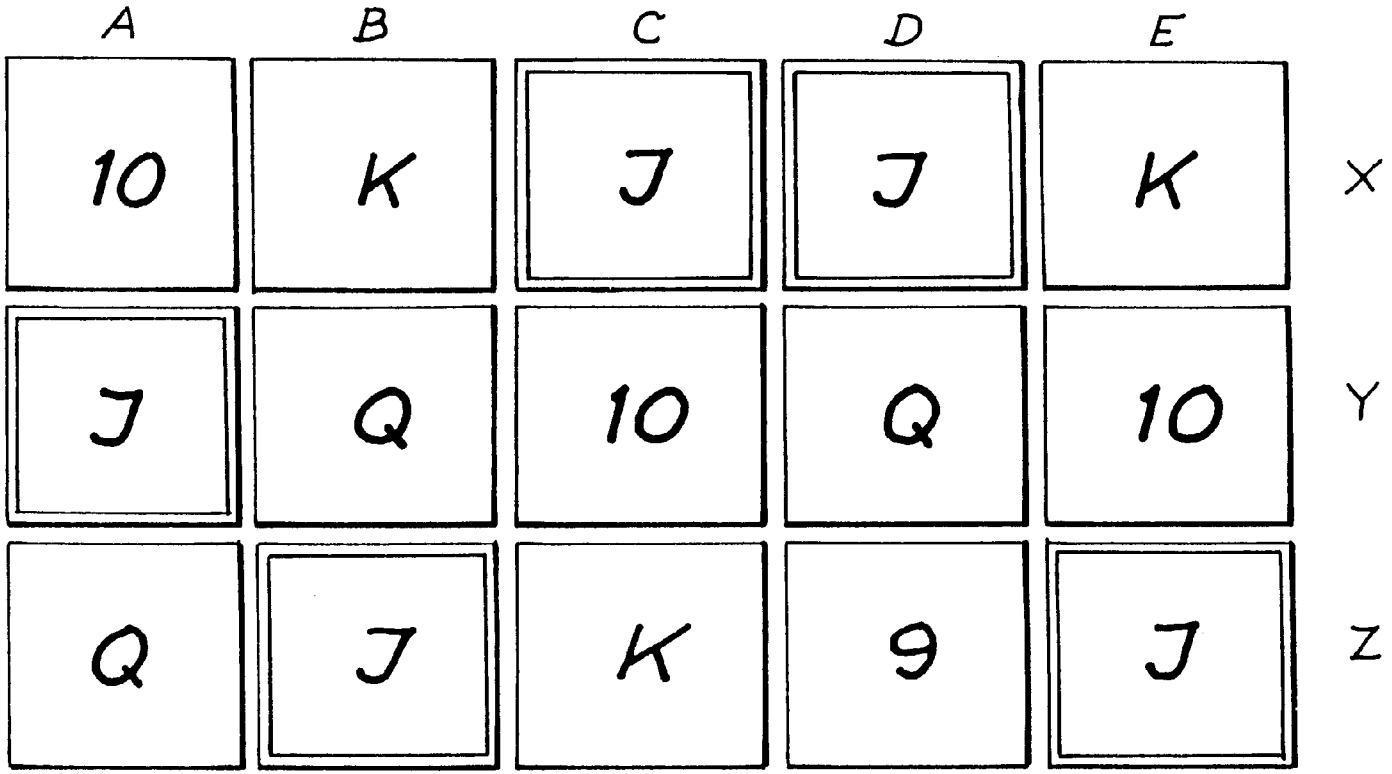
FIG. 2 illustrates a game example for a machine embodying the features of the present invention.
Figure 3:
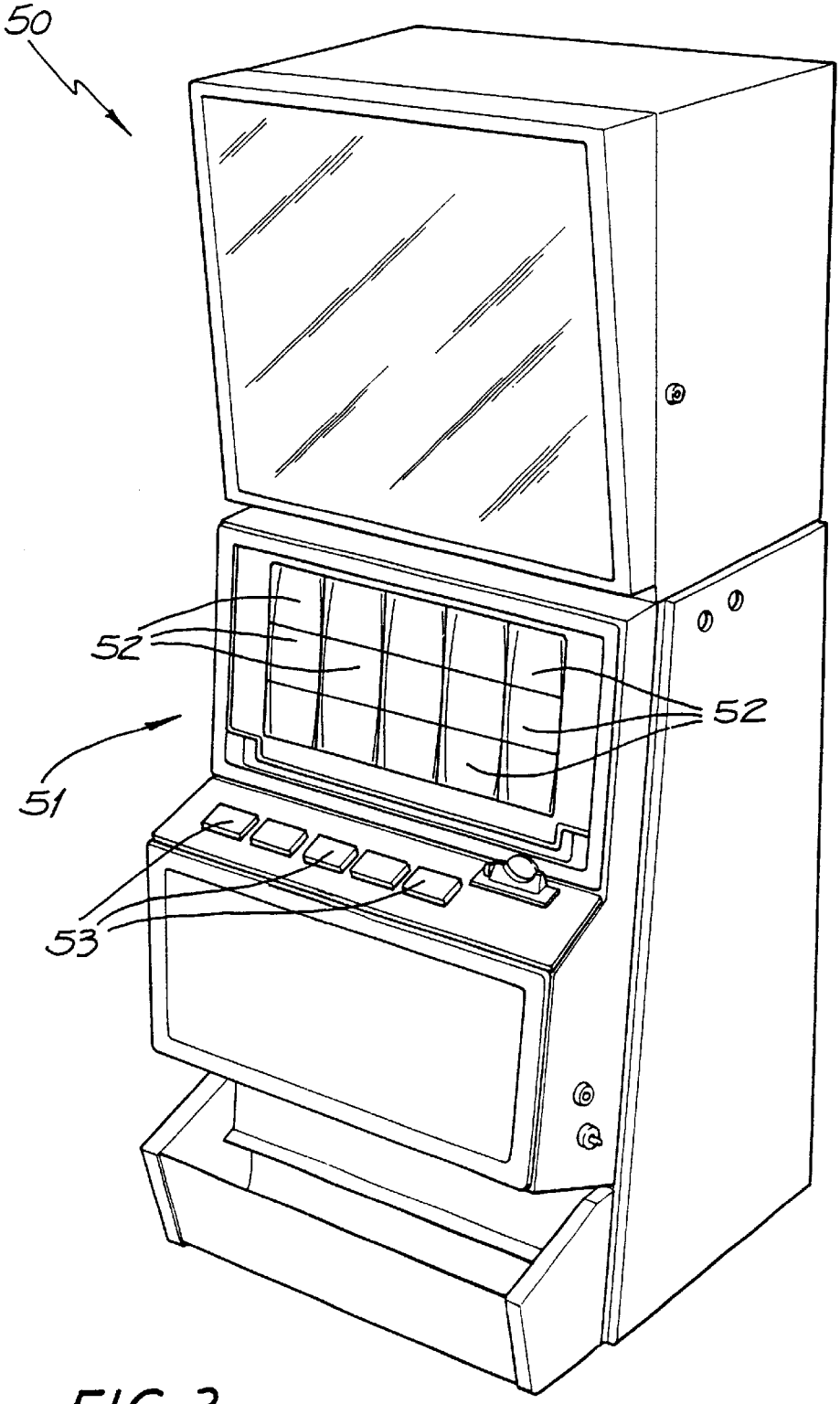
FIG. 3 illustrates a possible machine configuration in which the games described with reference to FIGS. 1 and 2 may be employed.

By way of example, take the case where a player plays a 9 line game and gets results displayed as illustrated in FIG. 2. The standard 9 line game has no winning combinations and accordingly the machine randomly selects and displays a mystery line superimposed over the symbol display. In the case shown in FIG. 2, the mystery line includes positions AY, BZ, CX, DX, EZ and contains 5 Jacks. A prize for 5 Jacks would then be paid to the player and the mystery line display would disappear when the next game is activated.

A number of mechanisms are possible for displaying the mystery line. In the case of a physical reel machine the respective windows could be lit with a different coloured light, the edges of the windows could be lit or the symbols could be carried on a translucent reel and backlit. In the case of a video machine the symbols could change colour or intensity (eg dull), the symbol background could change or a frame could be displayed around each selected symbol position.

Referring to FIG. 5, a slot machine 50 is illustrated in which paylines are selected for inclusion in a game by way of a touch sensitive membrane applied over the display screen 51, the membrane being divided into a number of switch panels 52 each of which corresponds with one display payline of the display 51. This arrangement can be used to implement the embodiments described with reference to FIGS. 1 and 2.

The machine of FIG. 5 is illustrated with a video display but may also make use of a display comprising a plurality of stepping motor driven reels carrying a plurality of symbols in which case switches 53 would include switches for line selection.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A gaming machine having display means arranged to display a plurality of symbols in an array of n rows and m columns, game control means arranged to control images displayed on the display means the game control means being arranged to pay a prize when a predetermined combination of symbols is displayed in a predetermined arrangement of symbol locations displayed on the display means, the gaming machine being characterised in that during each game a further arrangement of symbol locations is randomly selected and a prize is paid in the event that a predetermined combination of symbols is displayed in the randomly selected arrangement of symbol locations.

2. The gaming machine as claimed in claim 1, wherein the display is a video display.

3. The gaming machine of claim 2, wherein the randomly selected arrangement of symbol locations includes at least one location in every column of the display.

4. The gaming machine of claim 3, wherein the randomly selected arrangement of symbol locations includes only one location in each column.

5. The gaming machine of claim 3, wherein the display means displays symbols in 3 rows and 3, 4 or 5 columns.

6. The gaming machine as claimed in claim 3, wherein the machine is arranged to randomly select a number of additional arrangements of symbol locations in a game, the number of additional arrangements of symbol locations being greater than one, and each such arrangement including one and only one symbol location in each column of the display.

7. The gaming machine of claim 2 wherein the video display is arranged to display a simulation of a plurality of rotatable reels each carrying a plurality of symbols.

8. The gaming machine of claim 7, wherein the randomly selected arrangement of symbol locations includes at least one location in every column of the display.

9. The gaming machine of claim 8, wherein the randomly selected arrangement of symbol locations includes only one location in each column.

10. The gaming machine as claimed in claim 7, wherein the display means displays symbols in 3 rows and 3, 4 or 5 columns.

11. The gaming machine as claimed in claim 7, wherein the machine is arranged to randomly select a number of additional arrangements of symbol locations in a game, the number of additional arrangements of symbol locations being greater than one, and each such arrangement including one and only one symbol location in each column of the display.

12. The gaming machine as claimed in claim 1, wherein the display includes a plurality of rotatable reels, each reel carrying a plurality of symbols.

13. The gaming machine of claim 12, wherein the randomly selected arrangement of symbol locations includes only one location in each column.

14. The gaming machine of claim 13 wherein the randomly selected arrangement of symbol locations includes only one location in each column.

15. The gaming machine as claimed in 13, wherein the display means displays symbols in 3 rows and 3, 4 or 5 columns.

16. The gaming machine as claimed in claim 13, wherein the machine is arranged to randomly select a number of additional arrangements of symbol locations in a game, the number of additional arrangements of symbol locations being greater than one, and each such arrangement including one and only one symbol location in each column of the display.

* * * * *